United States Patent [19]

Porter

[11] Patent Number: 4,825,569

[45] Date of Patent: May 2, 1989

[54] TRENCH DIGGING, CABLE LAYING AND TRENCH FILLING APPARATUS

[76] Inventor: Roger D. Porter, Route 3, Box 626, Loris, S.C. 29569

[21] Appl. No.: 195,338

[22] Filed: May 17, 1988

[51] Int. Cl.[4] ..... E02F 5/22; F16L 1/02

[52] U.S. Cl. ..... 37/142.5; 405/174; 405/179

[58] Field of Search ..... 37/101, 142.5, 87, 91, 37/94, 80 A; 405/154, 157, 174–177, 179–183

[56] References Cited

U.S. PATENT DOCUMENTS

| | | | |
|---|---|---|---|
| 375,602 | 12/1887 | Carr | 405/179 |
| 1,174,271 | 5/1916 | Perry | 405/181 |
| 2,979,837 | 4/1961 | Hunter | 37/94 |
| 3,011,278 | 12/1961 | Lust | 37/142.5 X |
| 3,201,948 | 8/1965 | Schramm | 37/142.5 X |
| 3,319,365 | 5/1967 | Perry et al. | 37/94 |
| 3,332,249 | 7/1967 | Idoine | 37/142.5 X |
| 3,618,329 | 11/1971 | Hanson | 405/179 |
| 3,713,300 | 1/1973 | Ward | 405/182 |
| 4,429,477 | 2/1984 | Tice et al. | 37/80 R |
| 4,650,370 | 3/1987 | Kassner et al. | 405/179 |

*Primary Examiner*—Eugene H. Eickholt
*Attorney, Agent, or Firm*—Edwin E. Greigg

[57] ABSTRACT

A trench digging apparatus which is provided with a safety shield shaped to direct dug dirt back into the trench. The trench digger is also provided with a cable laying device which lays the cable in the dug trench ahead of the refilling dirt. A pipe pulling attachment may also be provided for laying a pipe while digging and refilling the trench.

10 Claims, 2 Drawing Sheets

TRENCH DIGGING, CABLE LAYING AND TRENCH FILLING APPARATUS

BACKGROUND OF THE INVENTION

The invention is directed to a trench digging, cable laying and trench refilling apparatus which is of single construction and small enough to be handled by one person.

Heretofore trench digging apparatuses have been set forth in U.S. Pat. Nos. 2,979,837, 3,319,365; and 4,429,477. Additionally, a trench digging, cable laying and trench refilling apparatus has been set forth in U.S. Pat. No. 3,332,249. Such trench digging devices have been made which are of relatively light weight such that one person may handle the apparatus. However, such digging apparatuses capable of both laying a cable and refilling the trench has been of heavy construction requiring a tractor for its movement and support Such a device requires more than one person to lift the device for transportation from one place to another.

It is therefore an object of this invention to provide a trench digging, cable laying and trench refilling device which is of light weight and easily handled and lifted by one person.

Another object is to provide a safety shield which guides the dirt for refilling the trench and which protects persons near the digger from the digging blade.

The invention will be better understood and further objects and advantages thereof will become more apparent from the ensuing detailed description of a preferred embodiment taken in conjunction with the drawings.

DETAILED DESCRIPTION

Figure 1:
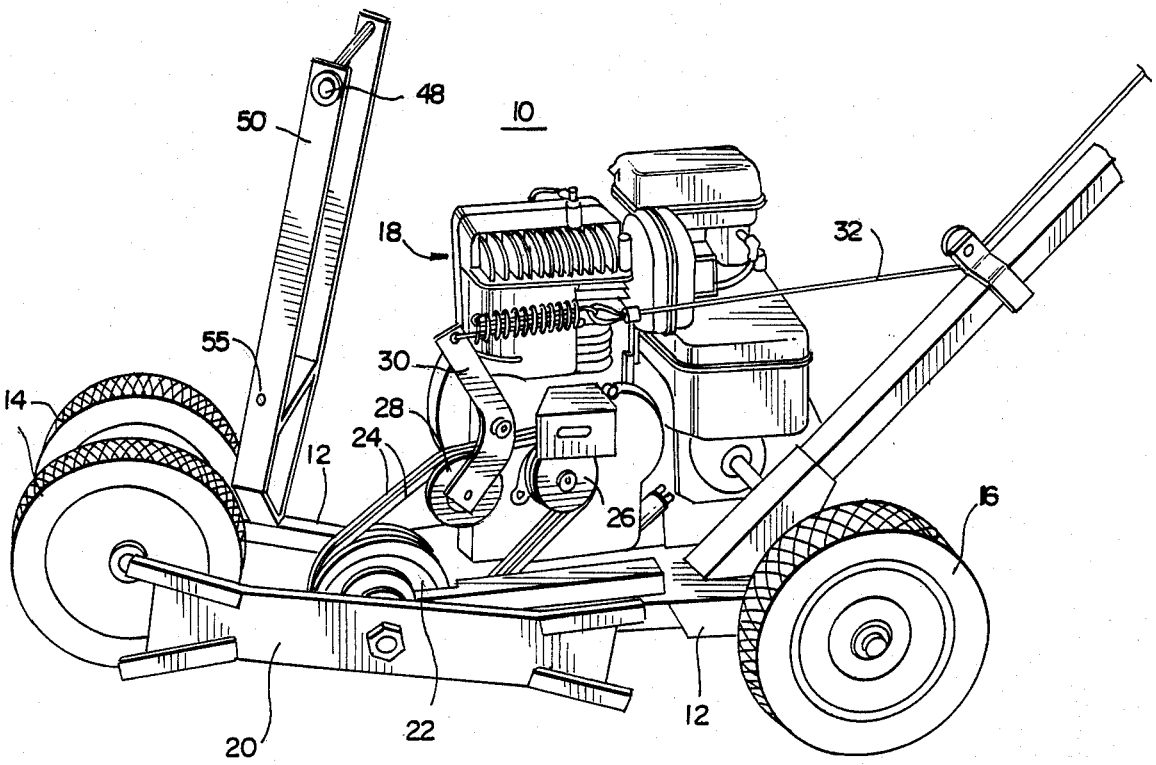
FIG. 1 is a side view of a trench digger.
Figure 2:
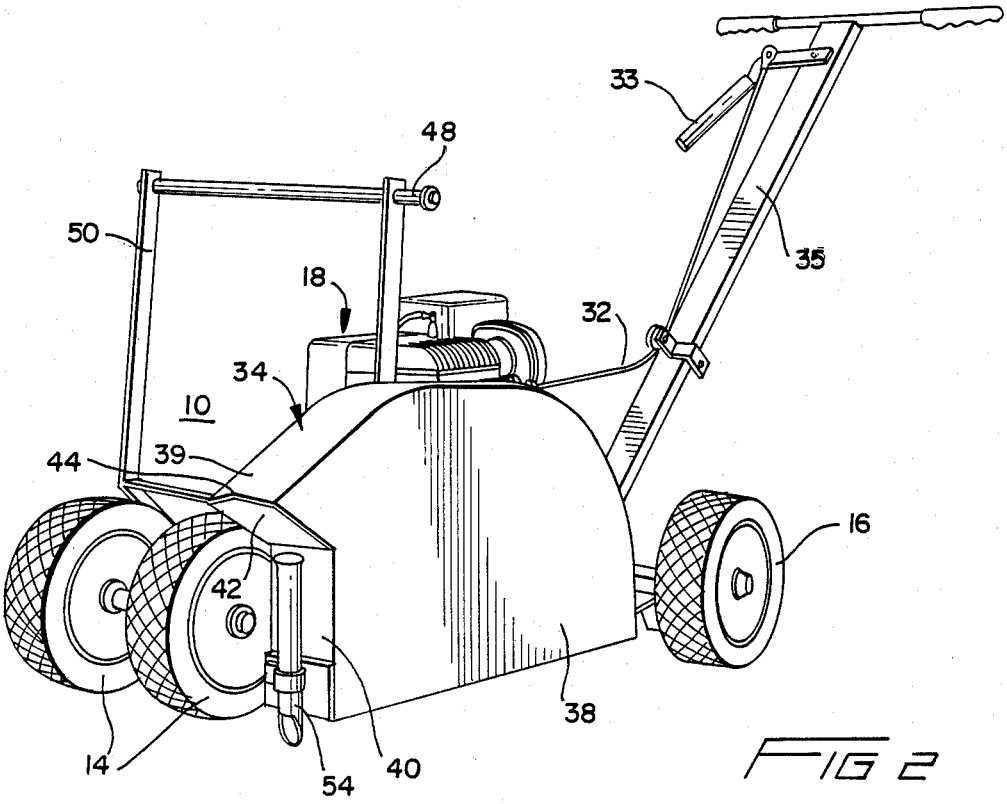
FIG. 2 is a perspective side view which illustrates the safety shield and loose dirt guide.
Figure 3:
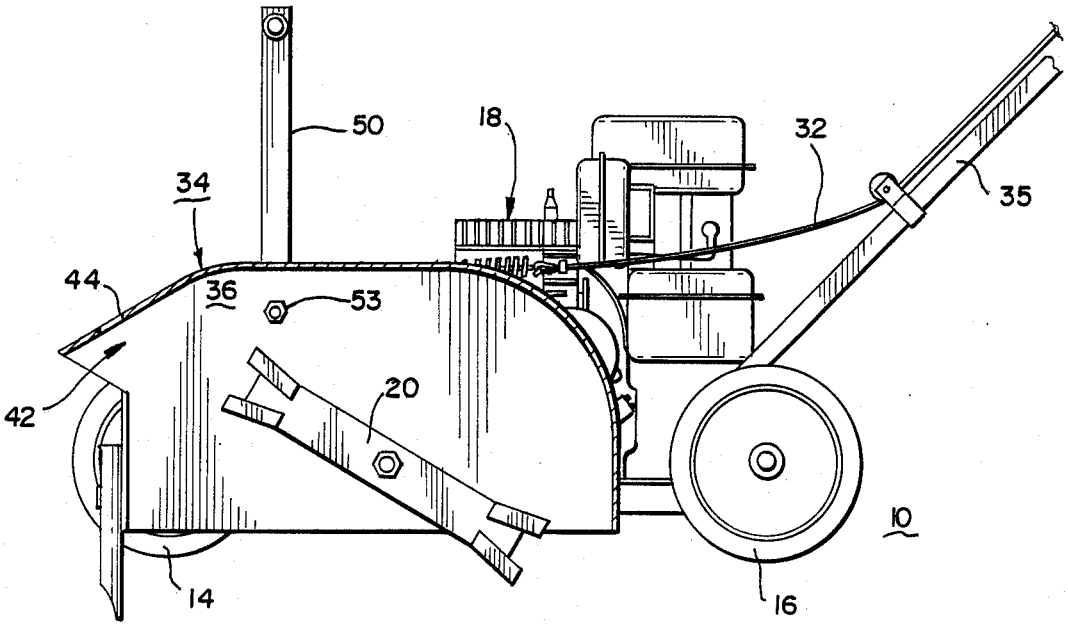
FIG. 3 is a side view with one side of the safety shield cut away to show the digging blade relative to the shield.
Figure 4:
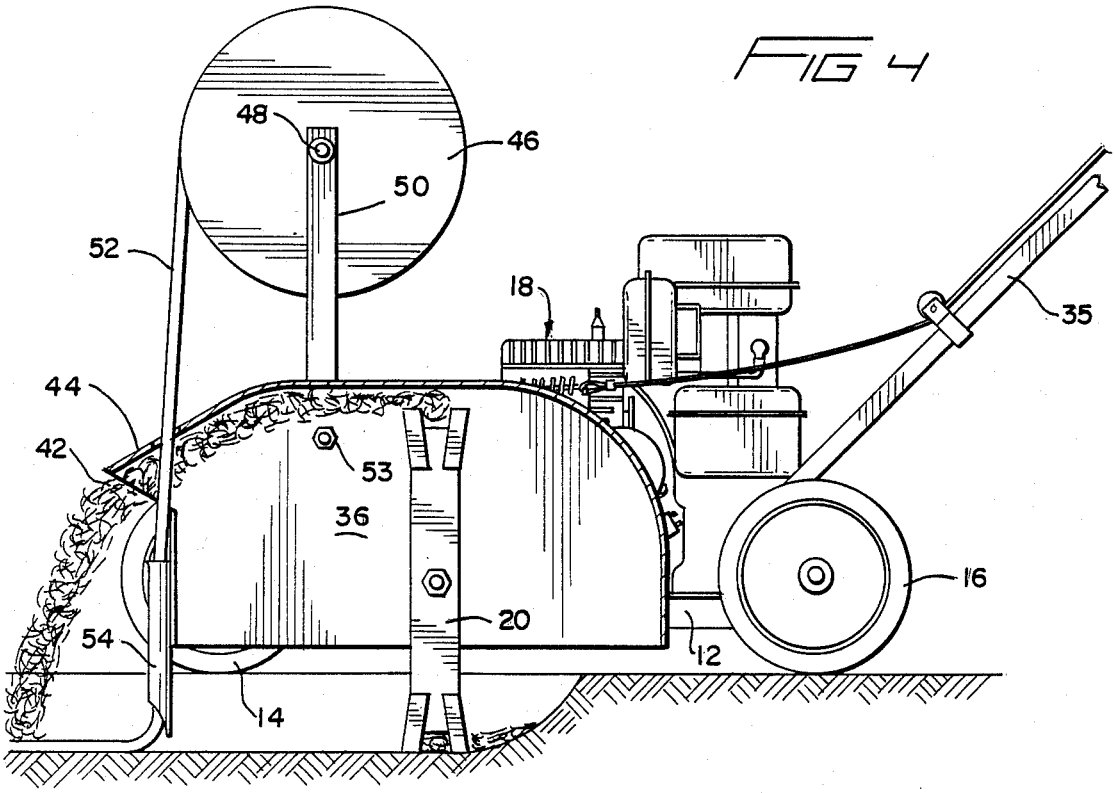
FIG. 4 is a side view with one side of the safety shield cut away to show the cable being laid and buried.

Now referring to the drawings, there is shown a trench digging, cable laying, trench filling apparatus according to this invention. FIG. 1 illustrates a trench digger 10 including a main frame 12 having front and rear wheels 14, 16 rotatable about an axle which supports the frame for movement on the wheels. The frame supports an engine 18 which drives a cutting or digging blade 20 via a double-pulley 22 and a pair of belts 24 driven by a double drive wheel 26 which is driven by the engine. A belt adjuster including an idler wheel 28 supported on an arm 30 and pivotable about a pivot is provided. The belt adjuster is controlled by a cable 32 and a belt tension lever 33 supported on handle 35 in order to tighten the drive belt which rotates the cutter blade.

A safety shield-loose dirt deflector 24 is provided. The safety shield-loose dirt deflector is formed by somewhat semicircular inner and outer plates 36, 38 which are spaced from each other and supported by the frame with the inner plate 36 inwardly of the cutter blade and the outer plate 38 outwardly of the cutter blade. The shield-loose dirt deflector extends downwardly so that the bottom is closed to the ground. It is open on its bottom to permit the blade to pass therethrough and is closed along the top 39 to enclose the blade from the top. A front plate 40 extends upwardly from the bottom surface and in front of the blade toward the top of the shield to leave an opening 42 through which loose dirt is thrown by the cutter blade The upper surface of the plates and top extend forward of the plate 40 to form a deflector end 44 which deflects the loose dirt back into the trench.

A spool of cable 46 is supported on a rod 48 by an upwardly directed frame 50 from which cable 52 is fed to be layed in the open trench ahead of the replaced loose dirt. The inner plate 36 of the shield is also secured to the cable supporting frame 50 by bolt 53 in aperture 55. The end of the cable is fed through a cable feed tubular member 54 or chute which is secured to the front plate 40 of the safety shield. The tubular member 52 is shown in an upward stored position so that the lower end is above the level of the bottom of the wheels so that the apparatus can be moved without the tubular member contacting the ground. During use the trench is begun, then the cable feed-tubular member is lowered so that the upper end is below the opening 42 in the safety shield and the lower end extends into the dug trench.

The operation is as follows:

(1) start engine, (2) tip apparatus backward until tip of blade in a vertical position is clear of the ground, and (3) depress belt tension lever 33 which pulls the belt tension adjustment to tighten belts 24, starting pulley 22 into motion, causing blade 20 to rotate on the same shaft. While blade 20 is spinning, lower the front wheels to the ground, causing blade 20 to open a trench in the ground. The apparatus is pulled manually in a direction of travel. Soil is picked-up and propelled by blade 20 through safety shield 34 out of opening 42 back into the trench. Cable chute 54 is lowered into the trench. Cable 52 is threaded through cable chute 4 and the end of the cable 10 is secured in place in the trench as the apparatus is pulled in direction of digging travel, cable 10 is fed from spool 46 through chute 54 into the open trench. Loose soil then falls on the cable in the bottom of the trench and covers the cable while refilling the trench.

In addition to, or instead of laying a cable in the trench, an end of a pipe may be attached to the end of the chute and pulled along with the apparatus while being fed in at a point of entry.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A trench digging, cable laying and trench filling apparatus which comprises a main frame, front and back wheels supporting said frame and rotatable about respective axles, a handle secured to said frame for moving said apparatus relative to a surface, a cutter blade secured to a rotary axle supported by said frame, a pulley means secured to said rotary axle for rotating said axle, drive means for driving said pulley means, control means for controlling rotation of said pulley means and said cutter blade, a safety shield secured to said frame relative to said cutter blade for protection from said cutter blade, said safety shield including inner and outer spaced plates on opposite sides of said cutter blade, a top enclosure for closing an area outwardly of said cutter blade and a front plate that closes a portion of an area in front of said cutter blade, and said front plate forming with said spaced plates and said top enclosure, an opening forming a safety shield chute which extends downwardly and forwardly of said front plate through which loose dirt is thrown by said cutter blade during use.

2. An apparatus as set forth in claim 1, which includes:

an upwardly extending frame secured to said main frame for supporting a cable spool, and a cable chute secured to said front plate through which a cable is fed for laying a cable in said trench during forming a trench by said cutter blade.

3. An apparatus as set forth in claim 2, which includes:

means for securing said inner plate of said safety shield to said upwardly extending frame.

4. An apparatus as set forth in claim 1, in which:

said drive means is a power engine which drives a drive pulley, and belt means operative relative to said drive pulley which drives said pulley means secured to said rotary axle for rotating said cutter blade.

5. An apparatus as set forth in claim 2, in which:

said drive means is a power engine which drives a drive pulley, and belt means operative relative to said drive pulley which drives said pulley means secured to said rotary axle for rotating said cutter blade.

6. An apparatus as set forth in claim 3, in which:

said drive means is a power engine which drives a drive pulley, and belt means operative relative to said drive pulley which drives said pulley means secured to said rotary axle for rotating said cutter blade.

7. An apparatus as set forth in claim 2, in which said cable chute is adjustable relative to a plane along said front and rear wheels.

8. An apparatus as set forth in claim 3, in which said cable chute is adjustable relative to a plane along said front and rear wheels.

9. An apparatus as set forth in claim 5, in which said cable chute is adjustable relative to a plane along said front and rear wheels.

10. An apparatus as set forth in claim 6, in which said cable chute is adjustable relative to a plane along said front and rear wheels.

* * * * *